US007628402B2

(12) United States Patent
Dobrindt

(10) Patent No.: US 7,628,402 B2
(45) Date of Patent: Dec. 8, 2009

(54) SHEET DELIVERY DEVICE FOR A PRINTING MACHINE

(75) Inventor: Dirk Dobrindt, Klausdorf/Schwentine (DE)

(73) Assignee: Eastman Kodak Company, Rochester, NY (US)

( * ) Notice: Subject to any disclaimer, the term of this patent is extended or adjusted under 35 U.S.C. 154(b) by 31 days.

(21) Appl. No.: 10/599,149

(22) PCT Filed: Mar. 18, 2005

(86) PCT No.: PCT/EP2005/002934

§ 371 (c)(1),
(2), (4) Date: Sep. 4, 2007

(87) PCT Pub. No.: WO2005/092754

PCT Pub. Date: Oct. 6, 2005

(65) Prior Publication Data

US 2007/0296144 A1 Dec. 27, 2007

(30) Foreign Application Priority Data

Mar. 22, 2004 (DE) ..... 10 2004 013 898

(51) Int. Cl.
*B65H 39/10* (2006.01)

(52) U.S. Cl. ..... 271/302; 271/200

(58) Field of Classification Search ..... 271/296, 271/302, 200, 264
See application file for complete search history.

(56) References Cited

U.S. PATENT DOCUMENTS

| | | | | |
|---|---|---|---|---|
| 4,548,403 | A * | 10/1985 | Matsui et al. | 271/296 |
| 5,078,385 | A * | 1/1992 | Serita | 271/296 |
| 5,101,241 | A * | 3/1992 | Watanabe | 399/403 |
| 5,105,231 | A | 4/1992 | Watanabe et al. | |
| 5,660,383 | A * | 8/1997 | Ueffinger et al. | 271/3.18 |
| 5,852,971 | A | 12/1998 | Yuyama et al. | |
| 6,042,108 | A * | 3/2000 | Morgan et al. | 271/201 |
| 6,325,369 | B1 | 12/2001 | Strutt | |
| 6,327,444 | B1 | 12/2001 | Hachisuga | |

FOREIGN PATENT DOCUMENTS

EP 0627671 7/1997

* cited by examiner

*Primary Examiner*—David H Bollinger
(74) *Attorney, Agent, or Firm*—Donna P. Suchy

(57) ABSTRACT

The invention relates to a sheet delivery device for a printing machine, preferably for an electrophotographically operating printing machine, comprising a transfer path on which sheets are transported from a path entry (1) of said transfer path to a path exit (2) of said transfer path via said transfer path. The object of the invention is to be able to adapt a sheet delivery device of the above-said type to various types of printing machines in a cost-effective and simple manner, preferably with minimal manipulation. In accordance with the present invention, this object is achieved in that a specific height level is assigned to the path exit (2), while the path entry (1) is configured in a height-variable manner.

4 Claims, 5 Drawing Sheets

SHEET DELIVERY DEVICE FOR A PRINTING MACHINE

Figure 1:
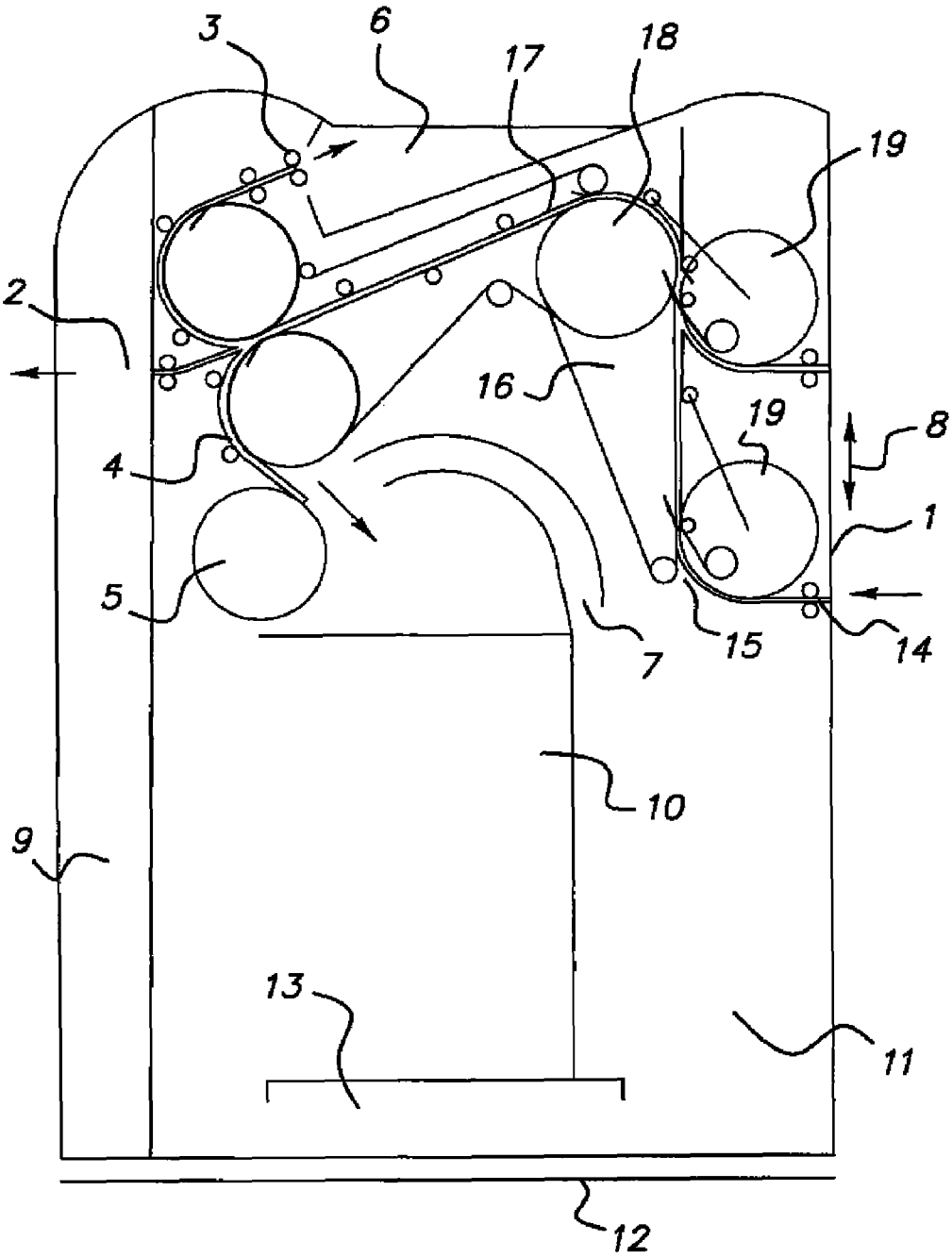

The invention relates to a sheet delivery device for a printing machine, preferably for an electrophotographically operating printing machine, comprising a transfer path on which sheets are transported from a path entry of said transfer path to a path exit of said transfer path via said transfer path.

Document DE 100 23 828 A1 discloses a sheet delivery device comprising a transfer path leading to different sheet receptacles, specifically to a stacking arrangement and a delivery tray.

An object of the invention is to be able to adapt a sheet delivery device of the above-said type to various types of printing machines in a cost-effective and simple manner, preferably with minimal manipulation.

In accordance with the present invention, this object is achieved in that a specific height level is assigned to the path exit, while the path entry is configured in a height-variable manner.

Specifically, by continuously shifting or pivoting a path segment or path element, the height of the path entry can be changed and adapted to different machines.

Preferably, the height level of the path exit corresponds to the maximum height level of the path entry. When the height of the path entry and the height of the path exit are at the same level, it is also possible, in particular, to arrange several delivery devices in a row.

One modification of the invention provides that the horizontal distance between the path exit and the path entrance is independent of the height changes of the path entry. This can be achieved, for example, in that only the region of the path entry itself can be moved perpendicularly, while the horizontal path segment retains its length. This offers the advantage that no additional baffles or other bridge components need be installed or de-installed for position changes.

Another modification provides that, when the height of the path entry is changed, the course of the transfer path changes automatically in such a manner that the entire length of the transfer path is retained as is and not only the horizontal segment of the path.

In each case, a simple change of the height of the path entry can be effected in that at least one position-variable deflecting element for the sheets to be transported is adjusted.

Thus, the total length of the path can advantageously be retained when an adjustment is made in that, in accordance with another modification of the invention, at least two successive deflecting elements located in the course of the transfer path together form an S-shaped path segment, which can be changed with respect to its elongation or its compression, or its arcs of warp for the sheets to be transported. If, as a result of a height adjustment, e.g. a pivoting operation, the position of a deflecting element is changed near the path entry (this potentially resulting in a lengthening of the path), the S-shape including the subsequent deflecting element can also be flattened automatically with this pivoting operation, i.e., the sheets to be transported are guided in a smaller arc of warp about the deflecting elements and, in so doing, the increased distance between the deflecting elements can be compensated for by minimizing the meandering of the path in order to keep the total path length the same.

Embodiments, which disclose additional inventive features, which, however, do not restrict the invention in its scope, are shown by schematic drawings.

They show in

Figure 2:
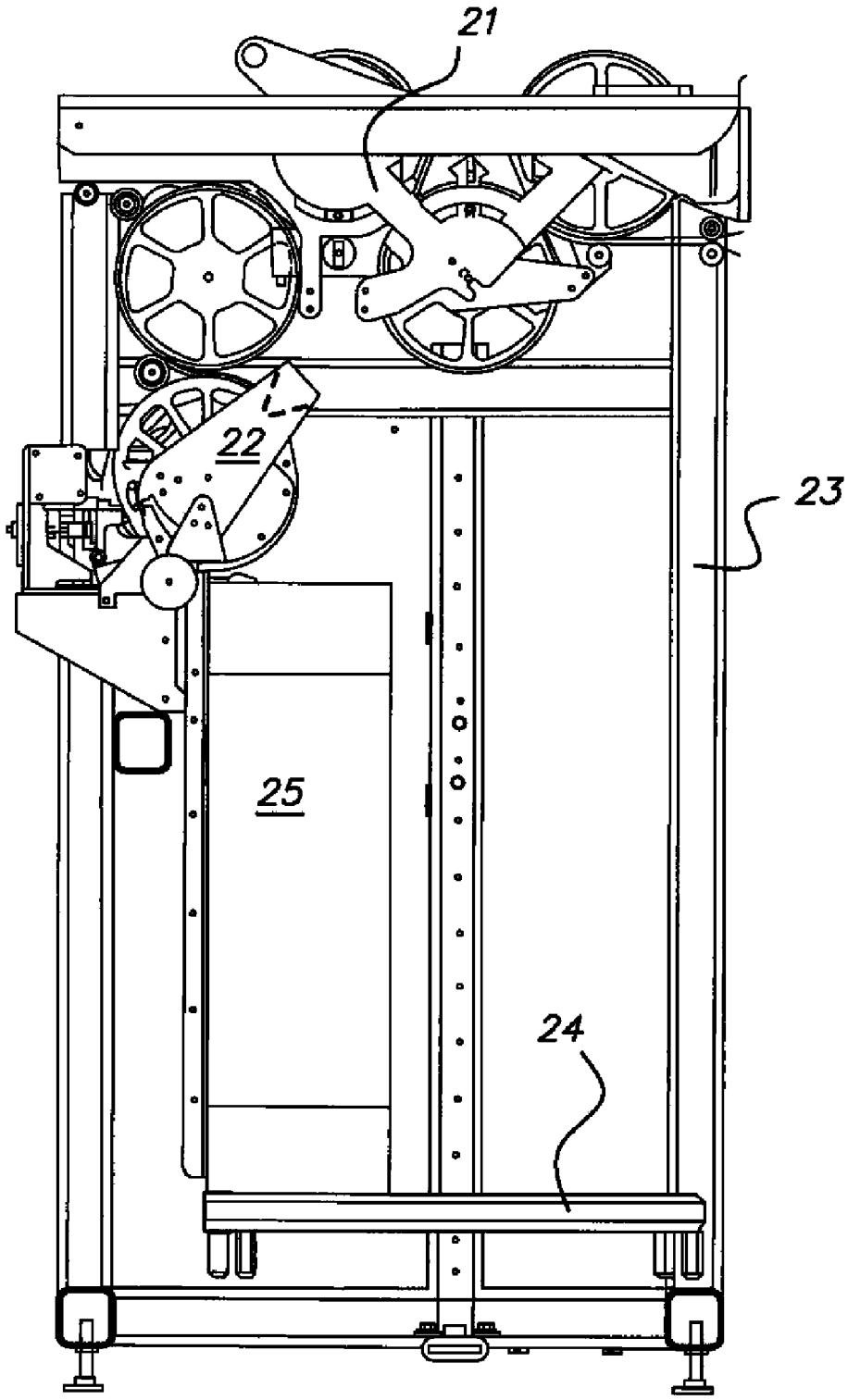
Figure 3:
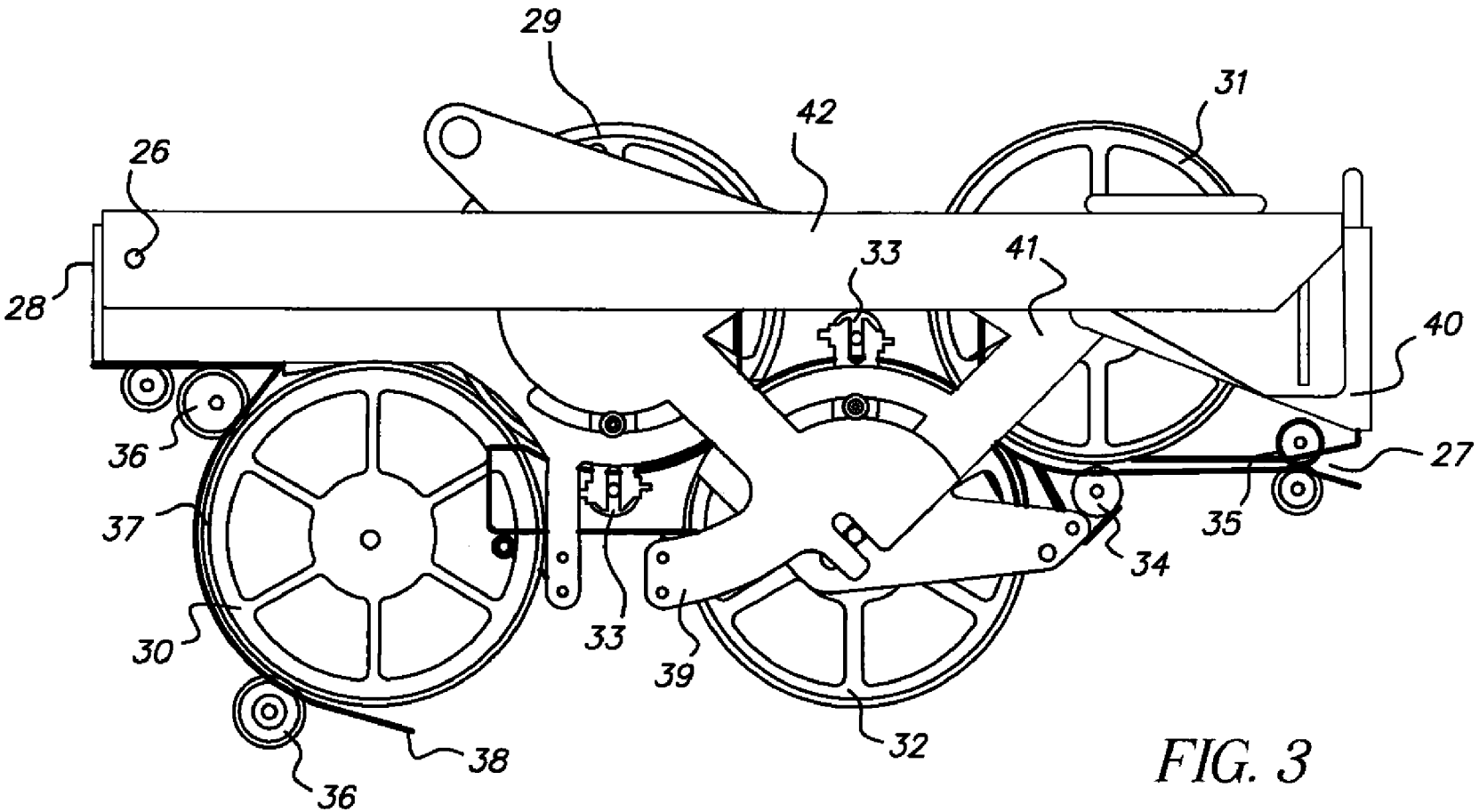
Figure 4:
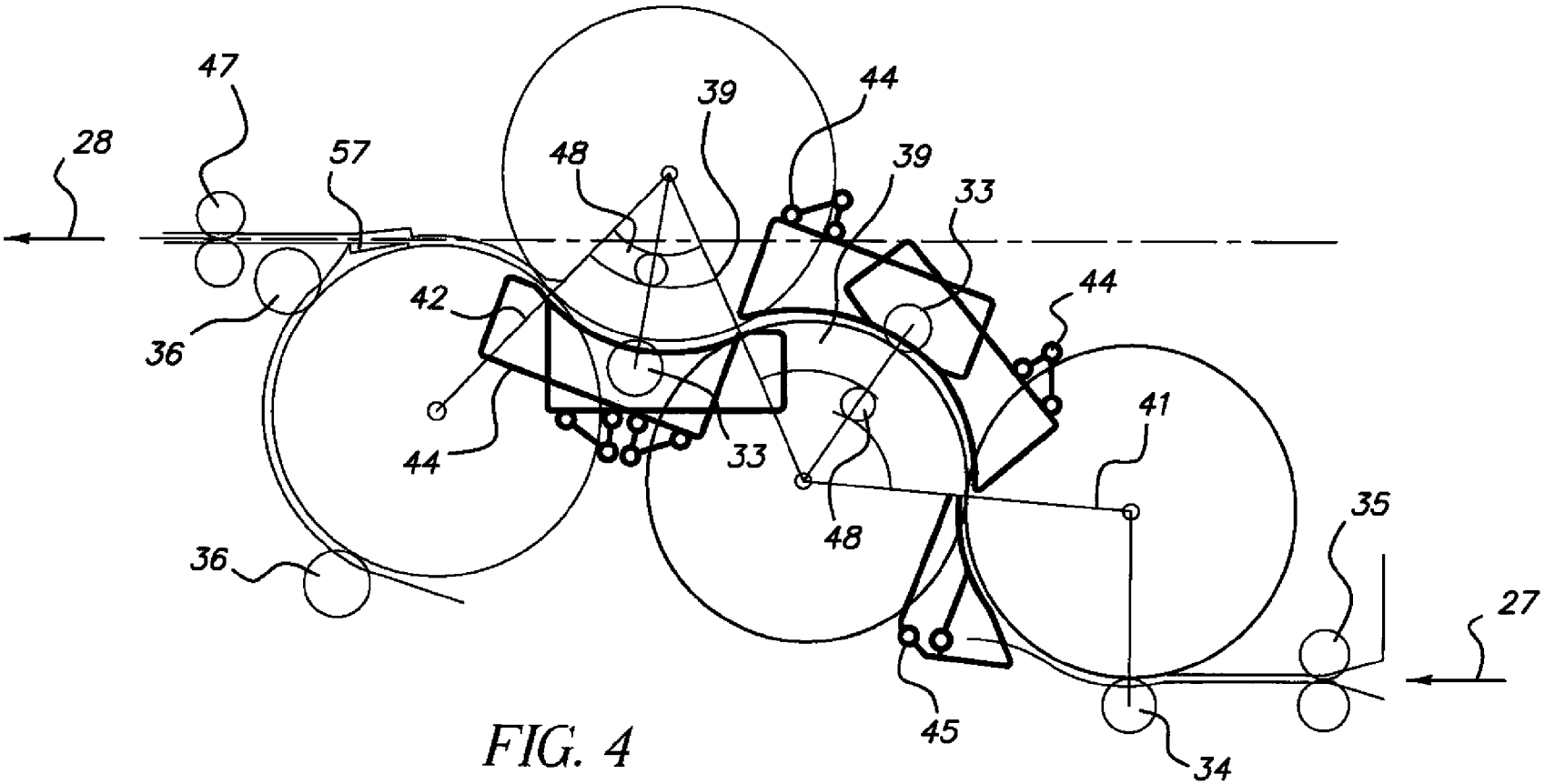
Figure 5:
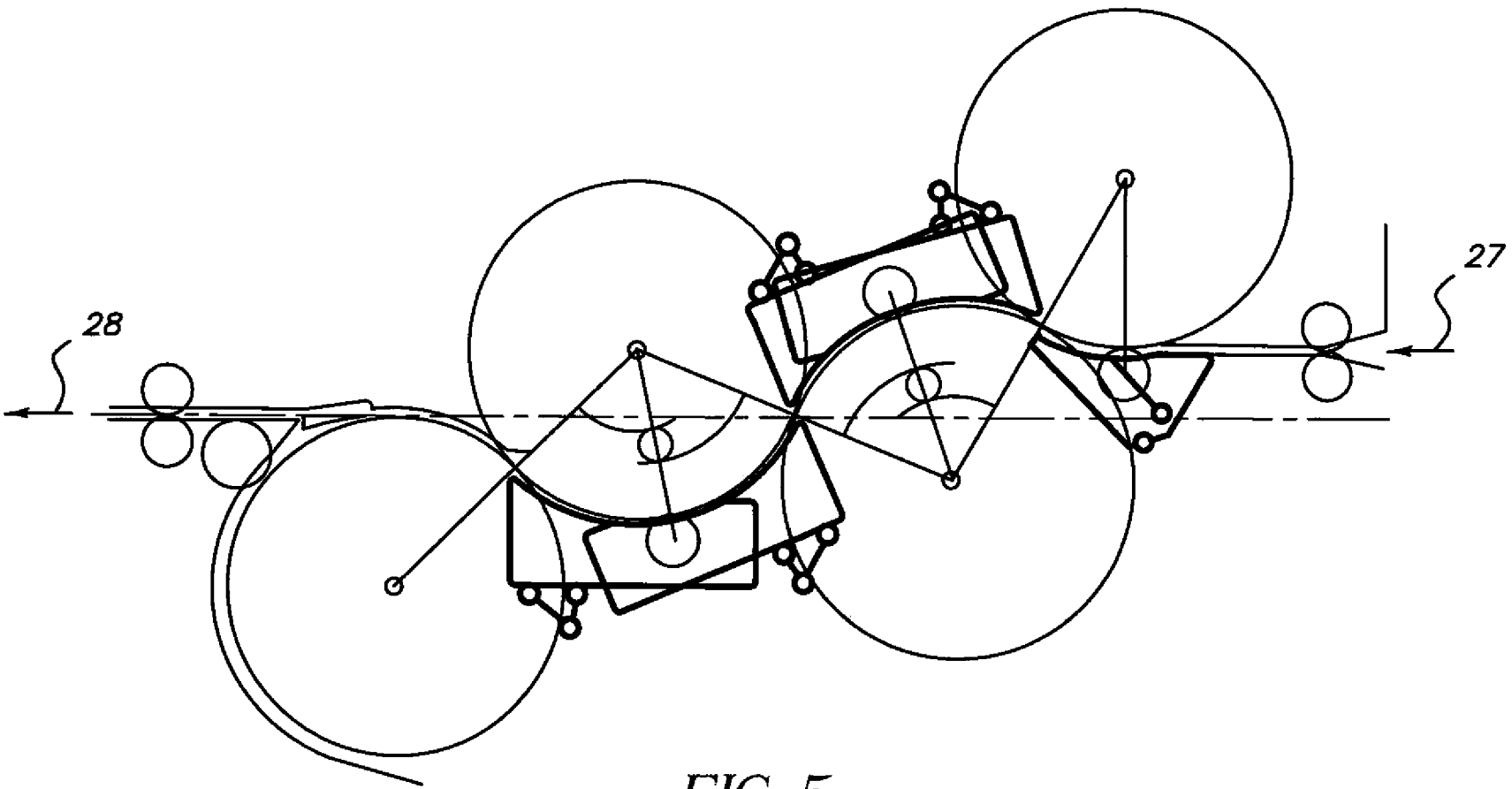

FIG. 1 a sectional view of a first embodiment of an inventive delivery device;

FIG. 2 a side view of a second embodiment of an inventive delivery device;

FIG. 3 a side view of a transport path of a device as in FIG. 2;

FIG. 4 a schematic diagram of the side view as in FIG. 3, depicting a lower position of the path entry of the transport path; and FIG. 5 the schematic diagram as in FIG. 4, depicting an upper position of the path entry.

FIG. 1 shows a first embodiment of the inventive sheet delivery device.

The transfer path of this delivery device is to implement high flexibility with respect to the most varied machine exits: (height adjustability); as well as to provide maximum functional clarity for the user, combined with low cost.

The embodiment depicted in FIG. 1 implements an adjustment range of 310 mm; however, larger adjustment ranges are conceivable. This simply requires a larger design space.

In this embodiment, path exit 2—via a rotating delivery system 5 for sheets to be transported—is given a fixed height level which corresponds to the maximum entry level of path entry 1. If the transfer path is lengthened, the path exit may be configured such that it can be set higher as well. However, in this embodiment, only a height-adjustable path entry is required.

Due to the height-adjustable path entry 1, the sheet delivery system may be mounted to the most diverse machines. In the case of this embodiment, it is important that the user or service technician can adapt path entry 1 to the required height level with minimal manipulation, i.e., without having to perform additional adjustments of interposed sheet metal elements.

For example, a sheet metal assembly would shorten the transfer path in transport direction, due to a pivoting motion out of the horizontal. This shortening would have to be compensated for by appropriate extension components. In addition, by pivoting the path entry downward, the design space for the sheet to be deposited would be blocked underneath the transport path. However, this is only one specific feature of the rotating sheet delivery system.

As a result of the demand for a transfer path without reducing the path length and with sufficient clearance beneath the path, the transfer path depicted in FIG. 1 was designed.

Starting at the entrance of transfer path 1, a main shifting element is provided, namely a large sheet-deflecting disk 19, 19' which, in this configuration, has a radius of 100 mm. This large, radius is necessary for heavy sheet types (300-350 $g/m^2$), and, hence, can be found in each deflecting region of this transfer path.

Sheet-deflecting disk 19, located close to the entry, represents the core element of a shiftable unit. In addition, located at the path entry, a pressure and driving roller pair 14 is provided on the vertically shiftable unit, said pair of rollers initially being responsible for the secure pick-up of sheets in this sheet delivery device. By way of a small horizontal sheet metal path, the thusly picked-up sheet is moved toward the sheet-deflecting disk located close to the entry.

While a lower metal baffle 15 follows the radius of sheet-deflecting disk 19 located close to the entry up to the vertical, an internal metal baffle terminates already in the point of intersection with sheet-deflecting disk 19.

In addition, there are, adjoining the sheet-deflecting disk in vertical direction on the shifting unit, additional pressure rollers which follow at a distance in vertical direction. Approximate distances of 90 mm must be maintained, so that a defined minimum sheet length of 203 mm can be guided securely through the machine. These 90 mm distances ensure that at least two pressure rollers transport the sheet at all times in transport direction. Thus, inadvertent twisting of the sheet to be transported is impossible.

On the left side of the sheet-deflecting disk 19 depicted in the drawing, a rigidly mounted flat belt system 16 is provided. When the height of path entry 1 is adjusted, sheet-deflecting disk 19, 19', as well as the superimposed pressure rollers, roll off on the flat belt. Also, the flat belt is deflected in the upper point of deflection having the large radius (R=100 mm). When the path entry position is at its highest level, the pressure rollers of the adjustment mechanism move on the large radius of the flat belt.

A second flat belt 17 then moves on the upper deflecting disk 18 following sheet-deflecting disk 19 farther to the left, in which case said flat belt is slightly inclined in downward direction so that paper path exit 2 is at the same height level as the highest level of path entry 1. With both heights being the same, it is possible to design several sheet delivery devices in a row.

Following another large deflection, the returning belt section of flat belt 17 moves over a deflecting roller back to the large deflecting disk 18. In the region of path exit 2, in addition, also a double switch is provided, i.e., two individual switches are arranged in series (not illustrated), which may clear a second and a third path.

The standard direction is the exit of the transfer path; the second direction is the feeding to the rotating sheet delivery system 5; the third path is the supply to a proof tray.

By means of the belt system and an exclusively central sheet transport, the transfer path may be designed in a largely open manner. For example, there is no need for a top cover along the entire straight transport path segment. The sheet to be transported is guided only by a lower metal baffle 15.

For properly guided passage, a top cover plate is provided ahead of the already described switch region. In the entry region, this cover plate has a V-shaped configuration so that the arriving sheet is gradually threaded—before the first switch—beginning at the center of the paper path into the path region.

Following the switch, again only a metal baffle is used on a feeder 4 for the rotating sheet delivery system 5. This baffle is located on the outside of the belt-deflecting disk. On this outside are pressure rollers, which—due to appropriate cutouts in the baffle—are supported by the flat belt and permit the sheet transport. Again, this design of deflection creates an extremely open paper path, which, in case of a paper jam, does not require opening of any covers to allow paper to be removed. The user can readily see whether or not a sheet is stuck in the paper path.

The lower metal baffle of the slightly inclined flat path is configured on the right side with the correspondingly large radius of the flat belt deflecting disk 18. After being bent, this metal baffle is extended downward, so that the left side of the vertical path is covered with a metal baffle.

However, a sheet that is to be transported perpendicularly also requires a right-side guide because, otherwise, the upper sheet corners could turn down. However, the right-side sheet guide requires that it must adapt correspondingly to the adjusted path entry height. For this reason, the right-side sheet guide is a tapeline guide (principle of a metal tape measure). This tapeline guide must consist of a slightly convex steel tape so that, on one hand, the sheet does not come into contact with the sharp outside edges and, on the other hand, the tape exhibits high intrinsic stiffness and hence withstands lateral pressure exerted by the transported sheet. When path entry 1 is adjusted, an appropriate length of the tapeline guide unrolls or rolls up. A downstream deflecting roller, which is configured so as to represent a drum, ensures a constant paper path nip. Thus a metal baffle having a flexible length is created. The vertical path segment contains two of these tapeline guides, so that the sheet corners are supported on both sides of the centrally placed flat belt.

In an alternative embodiment of the adjustable path region, a duplex transport system may be overlaid opposite the first central design. In so doing, two large sheet-deflecting disks 19 are positioned at a depth distance (transversely to transport direction) of approximately 150 mm. However, as a result, these two deflecting disks 19 have no access to the central flat belt. It is for this reason that two successive flat belt drives are required. The correspondingly required two additional, large flat belt deflecting disks are placed on the shaft of the central flat belt deflecting disks 18. These two additional flat belt deflecting disks then correspondingly guide two flat belts vertically in downward direction. There, two small flat belt deflecting rollers are arranged.

Due to the two support points of the sheet (viewed in depth, transverse to transport direction), the number of pressure rollers located above the sheet-deflecting disks can also be reduced. While the embodiment of central transport requires the use of three individual superimposed pressure rollers, each at a distance of 90 mm from the other, the number of pressure: rollers used in the embodiment described here can be reduced to one pair of pressure rollers. In this alternative embodiment, the tapeline guides are arranged correspondingly in front of and behind deflecting disks 18.

In the height-adjustable path entry 1 depicted in FIG. 1, there is no path reduction in horizontal direction, regardless of the selected continuous height adjustment. With the use of a simple linear guiding system, the adjustable path entry region can be shifted perpendicularly simply by loosening a screw (system is not illustrated in detail). A standard handle (not illustrated) allows a simple adjustment of the entry height.

In conclusion, it should be said regarding this embodiment that, by using many repeat components, a cost-effective paper path unit is provided, which, as required, can be height-adjustable within defined limits in the paper path entry region.

FIG. 2 is a side view of a second example of embodiment of an inventive sheet delivery device.

The sheet delivery device comprises a transfer path 21 for the sheets to be transported, said transfer path extending from a height-variable path entry 27 to a path exit 28 (FIG. 3). Sheets that are to be transported and stacked are fed to a rotating delivery system 22, which creates a stack of sheets 25 with the sheets that are deposited on a stack tray 24. Transfer path 21 and delivery system 22 with the stack tray are arranged on a frame 23.

The special feature of this embodiment of the transport path is that the transport path does not extend in a straight line, but that the sheets to be transported are wound around deflecting disk pairs 29, 30, 31, 32. In so doing, the deflecting disk pairs are supported by pressure roller pairs 33, 34 and 36 (FIG. 3).

In the already mentioned FIG. 3, the transfer path is depicted again in greater detail in a side view.

Located at path entry 27 are driving rollers 35, which move the sheets to be transported into the transport path. From there, the sheets are transported with the aid of deflecting disks and pressure rollers and, under normal circumstances, are finally guided—along a metal baffle 37—to delivery system 22 at a path end 38. The elements of the transfer path are arranged on sheet metal components 40, 42 and profiles 39, 41, which, together, can be pivoted about a pivotal point 26. To do so, sheet metal component 40 is provided with a handle.

FIGS. 4 and 5 are schematic diagrams of the transfer path indicating the maximum lowest (FIG. 4) and the maximum highest positions (FIG. 5) of the (continuously) height-variable path entry 27 and the corresponding positions of the affected elements of the transfer path. The same components have the same reference numbers as in the previous Figures. In addition, additional extruded profiles 44, 45 for sheet deflection are depicted. In particular, it is also obvious that profile 41 is configured as a lever arm which can be adjusted or angled. The lever arm ranges can be adjusted with gearwheels 48.

Located at path exit 28—which, for example, may lead to a single sheet ejection, a proof tray or the like—are driving rollers 47, which move the sheets out of transfer path 21. An upstream paper path switch 57 guides sheets to path end 28 or to path end 38 (FIG. 3).

For purposes of clarity, most of the reference numbers have been left out in FIG. 5.

Hereinafter, position changes of path entry 27 and the affected elements of transfer path 21 will be explained in detail. In so doing, each deflecting disk is driven by a synchronous belt drive which can follow the adjustment options. The motor may be a stepper motor, for example, which also drives the rotating delivery system, for example. The synchronous belt and the stepper motor are not depicted in the drawing.

In particular, it is obvious from FIGS. 3 through 5 that the transfer path comprises a total of four pairs of deflecting disks.

The deflecting disk pair 30 depicted on the left outside is responsible for the deflection by 180 degrees toward switch 57. If the height of path entry 27 is adjusted, this deflecting disk pair 30 is not moved along. This deflecting disk pair can be moved only if a paper jam occurs. Then, this deflecting disk pair can be pivoted about an imaginary pivot point (not illustrated in detail) in the center of the rotating delivery system 22 in the direction of stack tray 24.

Likewise, the subsequent deflecting disk pair 29 does not participate in the height adjustment operation. Only the two deflecting disk pairs 31, 32 on the right side of the illustrations roll on each other and off the stationary deflecting disk pair 29 located on the left side.

From deflecting disk pair 29 extends a lever arm pair 39, which receives movable deflecting disk pair 32.

Likewise, a lever arm pair 41 extends from deflecting disk pair 31, said lever arm pair also receiving deflecting disk pair 32. Receiving sites for deflecting disk pair 32 are configured as slots in lever arms 39, 41. By means of said slots, in which the drive shaft of deflecting disks 32 is supported, a tolerance compensation among deflecting disks 29, 31, 32 may occur. Thus, a secure abutment of each deflecting disk is ensured.

The two lever arm pairs 39, 41 are spring-biased relative to each other. A tension spring (not depicted in the illustrations) mounted close to the drive shaft support of deflecting disk pair 32 on lever arm 39, 41, respectively, prevents deflecting disks 32 from falling down and, at the same time, achieves the pressure required between deflecting disks 32.

The right deflecting disk pair 31 is held by a sheet metal support 40, which is mounted to path base frame 42, said frame accommodating lever arm 39, as well as stationary deflecting disk pair 29 and sheet metal support 40. Base frame 42 is rotatably supported on the left side. If the height of path entry 27 is to be adjusted, sheet metal support 40 must be: loosened from path base frame 42 by means of a screw. The height can be adjusted by using a handle located on sheet metal support 40. In so doing, the loosened screw of sheet metal support 40 is guided in a vertical longitudinal slot of base frame 42, said longitudinal hole defining the adjustment range.

After reaching the desired path entry height, the previously loosened screw is tightened again. The adjustment procedure has been completed. Any path adaptation such as, for example, the alignment of deflecting contours 44, 45 and pressure rollers 33, 34, occurs automatically in the path. Elements automatically find their respective central alignment.

All of this follows the basic principle of the operation of scissors, whereby both scissors halves are connected via a centrally located gearwheel over rack contours extending radially to a joint pivot point. If one scissors half is moved—considering the pivot point and the centrally located gearwheel as a stationary basis in this case—the other scissors half carries out the corresponding movement.

This principle is also followed by pressure rollers 33 used in the path.

The two lever arms 39, 41, which have received the movable deflecting disk pair 32, also have gear profiles radially with respect to this joint pivot point. The gear profiles may be provided, for example, directly in the lever arm sheet metal, for example, by machining with a laser. Located in the joint pivot point is another lever arm pair, which accommodates pressure roller 33. Likewise, each lever arm has a gearwheel 48 with which the opposing two gear profiles of the lever arms may move on rolling contact. If, during assembly, the pressure roller is installed in the center between the two lever arms, this central alignment is retained in any angular position.

Likewise, in this manner, pressure roller 33 is aligned underneath stationary deflecting disk 29. The only special feature in this case is that only one movable lever arm 39 initiates the adjustment. The other, imaginary; lever arm is located in base frame 42.

Extruded profiles 44, 45, which represent the counterpart of the deflecting disks, are mounted to a lever arm 39, 41, respectively.

Considering the following situation, again the movable deflecting disk 32 will be used. Respectively on the right and left lever arm 41, the same extruded profile 44—only laterally reversed—is attached. These extruded profiles 44 are located above deflecting disk 32 and, corresponding to their contour, form a gap opposite the deflecting disk. This gap is not created across the entire path depth. Only narrow regions in front of and behind the deflecting disk cover these extruded profiles 44. As a result, the user of the machine is given the best possible view into path 21.

Extruded profiles 44 are designed in such a manner that, in the smallest angular position of lever arms 39, 41, the profiles move past each other and thus do not impair the areas of contact of two deflecting disks moving off each other. In the largest-possible angular position, the two extruded profiles on respectively opposing lever arms overlap only in the center where pressure roller 33 is also located. A secure transfer from one extruded profile to the other extruded profile 44 is ensured by a small overlap in this region. It is not possible for the leading edge of the sheet to be transported to become caught at any point in the path.

The entry region and the transfer region in front of switch 57 are designed based on the same principle.

As already mentioned, the entire sheet-guiding operation occurs only over two very narrow regions of the sheet. In so doing, these regions are depicted by deflecting disks or pressure rollers, and by extruded profiles located on the right and left sides (viewed from the top). The regions in between are exposed. Still, the sheet may not take any form, which means that it cannot drop down laterally because the transported sheet is subject to a continuous radial deflection, which causes the sheet to be stiffened. Due to these circumstances, it is also easier to re-thread the sheet in front of switch 57 in the path. With the aid of an upper sheet metal cover, which is V-shaped like a snow-plough and which gradually re-threads the outer areas of the sheet, a non-damaging transport of the sheet through the remaining path is made possible.

Because the deflecting disk region is exposed, the user can readily see if a sheet was left in this section of the path in case of a paper jam. Should this be the case, path frame 42 must be pivoted up about the left-side pivot point 26 and thus opened. By rotating deflecting disk pair 32, the sheet may be transported out of this access region. After removing the sheet, the path region is again pivoted down. The sheet transport can be resumed.

To ensure a secure sheet pickup and sheet delivery, known drive systems, comprising a drive shaft and a pressure roller, are installed. At the same time, a short section of these drive systems is enclosed by metal baffles.

The response to potential concerns that the severe deflections of the sheets could lead to greater delivery inaccuracies is that—considering the increasing disk size with the diameter tolerances remaining the same—delivery inaccuracies are in fact minimized.

Of course, the S-shaped curved sections passed by the sheets can cause a transverse offset in the path. However, this would be repeated to the same degree with each deposited sheet. Ultimately, the stack would again be aligned uniformly, but with an offset. The delivery operation would not be impaired by this.

Finally, it should be said that by using many repeat parts, a cost-effective path unit is provided, which, as demanded, is height-adjustable within defined limits in the path entry region.

The invention claimed is:

1. A sheet delivery device for a printing machine, preferably for an electrophotographically operating printing machine, comprising:

a transfer path on which sheets are transported from a path entry of said transfer path to a path exit of said transfer path via said transfer path, wherein a specific height level is assigned to the path exit, while the path entry is configured in a height-variable manner, and at least two successive deflecting elements located in the course of the transfer path together form an S-shaped path segment.

2. Sheet delivery device as in claim 1, wherein the height level of the path exit corresponds to the maximum height level of the path entry.

3. Sheet delivery device as in claim 1, wherein the horizontal distance between the path exit and the path entry is independent of the height adjustment of the path entry.

4. Sheet delivery device as in claim 1, when the height of the path entry is changed, the course of the transfer path changes automatically in such a manner that the length of the transfer path is retained as is.

* * * * *